US010078998B2

(12) United States Patent
Chu et al.

(10) Patent No.: US 10,078,998 B2
(45) Date of Patent: Sep. 18, 2018

(54) GAMMA CURVE AND COLOR COORDINATE ADJUSTING APPARATUS AND ADJUSTING METHOD THEREOF

(71) Applicant: Novatek Microelectronics Corp., Hsinchu (TW)

(72) Inventors: Po-Shen Chu, Taoyuan (TW); Chun-Ta Wu, New Taipei (TW); Hong-Jun Hsiao, Hsinchu County (TW); Chieh-Hsiang Chang, Miaoli County (TW); Feng-Jung Kuo, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 268 days.

(21) Appl. No.: 14/819,436

(22) Filed: Aug. 6, 2015

(65) Prior Publication Data

US 2017/0039989 A1 Feb. 9, 2017

(51) Int. Cl.
*G09G 5/02* (2006.01)
*G09G 5/10* (2006.01)

(52) U.S. Cl.
CPC ..... *G09G 5/02* (2013.01); *G09G 5/10* (2013.01); *G09G 2320/0666* (2013.01); *G09G 2320/0673* (2013.01); *G09G 2320/0693* (2013.01)

(58) Field of Classification Search
CPC .... G09G 5/02; G09G 5/10; G09G 2320/0693; G09G 2320/0673; G09G 2320/0666
See application file for complete search history.

(56) References Cited

U.S. PATENT DOCUMENTS

2004/0246273 A1* 12/2004 Rykowski ..... G09G 5/06 345/690
2007/0052735 A1* 3/2007 Chou ..... H04N 9/69 345/690
2012/0242680 A1* 9/2012 Park ..... G09G 3/3233 345/590
2015/0348505 A1* 12/2015 Pyo ..... G09G 5/10 345/589

* cited by examiner

*Primary Examiner* — Aneeta Yodichkas
(74) *Attorney, Agent, or Firm* — JCIPRNET

(57) ABSTRACT

A gamma curve and a color coordinate adjusting apparatus and method are provided. The method includes: receiving a display image and generating a color analyzing data, wherein the color analyzing data comprises a plurality of stimulus values respectively corresponding to a plurality of driven gray levels; receiving a target color coordinate value and a target luminance value; operating a searching operation according to a setting range on the color analyzing data, calculating a simulation color coordinate value and a simulation luminance value according to the stimulus values of each of the driven voltage levels, and obtaining a plurality of adjusted node information for the gamma curve and the color coordinate according to a difference between the target color coordinate value and the simulation color coordinate value and a difference between the target luminance value and the simulation luminance value corresponding to each of the driven voltage levels.

16 Claims, 5 Drawing Sheets

311

| DVL1 | X1 | Y1 | Z1 |
|---|---|---|---|
| 0 | 150.834 | 79.4038 | 13.3864 |
| 1 | 150.7882 | 79.3938 | 13.3748 |
| ⋮ | ⋮ | ⋮ | ⋮ |
| 155 | 145.9662 | 76.57605 | 12.27312 |
| ⋮ | ⋮ | ⋮ | ⋮ |
| ⋮ | ⋮ | ⋮ | ⋮ |
| ⋮ | ⋮ | ⋮ | ⋮ |
| 1022 | 0.1308 | 0.1313 | 0.202 |
| 1023 | 0.1314 | 0.1317 | 0.2004 |

312

| DVL2 | X2 | Y2 | Z2 |
|---|---|---|---|
| 0 | 144.2945 | 292.5997 | 39.6846 |
| 1 | 144.3133 | 292.6579 | 39.6785 |
| ⋮ | ⋮ | ⋮ | ⋮ |
| ⋮ | ⋮ | ⋮ | ⋮ |
| ⋮ | ⋮ | ⋮ | ⋮ |
| 281 | 124.0139 | 249.5927 | 33.54319 |
| ⋮ | ⋮ | ⋮ | ⋮ |
| 1022 | 0.1317 | 0.1321 | 0.1982 |
| 1023 | 0.1310 | 0.1312 | 0.2000 |

313

| DVL3 | X3 | Y3 | Z3 |
|---|---|---|---|
| 0 | 74.0848 | 28.6050 | 393.6091 |
| 1 | 74.12 | 28.6221 | 393.5556 |
| ⋮ | ⋮ | ⋮ | ⋮ |
| ⋮ | ⋮ | ⋮ | ⋮ |
| 62 | 73.21787 | 28.26703 | 389.3398 |
| ⋮ | ⋮ | ⋮ | ⋮ |
| ⋮ | ⋮ | ⋮ | ⋮ |
| 1022 | 0.1308 | 0.1299 | 0.2001 |
| 1023 | 0.1312 | 0.1313 | 0.1996 |

R30

FIG. 3A

311

| DVL1 | X1 | Y1 | Z1 |
|---|---|---|---|
| 0 | 150.834 | 79.4038 | 13.3864 |
| 1 | 150.7882 | 79.3938 | 13.3748 |
| ⋮ | ⋮ | ⋮ | ⋮ |
| 169 | 144.7539 | 75.89045 | 12.12312 |
| ⋮ | ⋮ | ⋮ | ⋮ |
| ⋮ | ⋮ | ⋮ | ⋮ |
| ⋮ | ⋮ | ⋮ | ⋮ |
| 1022 | 0.1308 | 0.1313 | 0.202 |
| 1023 | 0.1314 | 0.1317 | 0.2004 |

312

| DVL2 | X2 | Y2 | Z2 |
|---|---|---|---|
| 0 | 144.2945 | 292.5997 | 39.6846 |
| 1 | 144.3133 | 292.6579 | 39.6785 |
| ⋮ | ⋮ | ⋮ | ⋮ |
| ⋮ | ⋮ | ⋮ | ⋮ |
| ⋮ | ⋮ | ⋮ | ⋮ |
| 287 | 122.9828 | 247.4756 | 33.25552 |
| ⋮ | ⋮ | ⋮ | ⋮ |
| 1022 | 0.1317 | 0.1321 | 0.1982 |
| 1023 | 0.1310 | 0.1312 | 0.2000 |

313

| DVL3 | X3 | Y3 | Z3 |
|---|---|---|---|
| 0 | 74.0848 | 28.6050 | 393.6091 |
| 1 | 74.12 | 28.6221 | 393.5556 |
| ⋮ | ⋮ | ⋮ | ⋮ |
| ⋮ | ⋮ | ⋮ | ⋮ |
| 86 | 72.60599 | 28.0234 | 386.4474 |
| ⋮ | ⋮ | ⋮ | ⋮ |
| ⋮ | ⋮ | ⋮ | ⋮ |
| 1022 | 0.1308 | 0.1299 | 0.2001 |
| 1023 | 0.1312 | 0.1313 | 0.1996 |

FIG. 3B

411

| DVL1 | X1 | Y1 | Z1 |
|---|---|---|---|
| 0 | 150.834 | 79.4038 | 13.3864 |
| 1 | 150.7882 | 79.3938 | 13.3748 |
| ⋮ | ⋮ | ⋮ | ⋮ |
| 131 | 147.6093 | 77.47826 | 12.50655 |
| ⋮ | ⋮ | ⋮ | ⋮ |
| ⋮ | ⋮ | ⋮ | ⋮ |
| ⋮ | ⋮ | ⋮ | ⋮ |
| 1022 | 0.1308 | 0.1313 | 0.202 |
| 1023 | 0.1314 | 0.1317 | 0.2004 |

412

| DVL2 | X2 | Y2 | Z2 |
|---|---|---|---|
| 0 | 144.2945 | 292.5997 | 39.6846 |
| 1 | 144.3133 | 292.6579 | 39.6785 |
| ⋮ | ⋮ | ⋮ | ⋮ |
| ⋮ | ⋮ | ⋮ | ⋮ |
| ⋮ | ⋮ | ⋮ | ⋮ |
| 272 | 125.4605 | 252.545 | 33.95781 |
| ⋮ | ⋮ | ⋮ | ⋮ |
| 1022 | 0.1317 | 0.1321 | 0.1982 |
| 1023 | 0.1310 | 0.1312 | 0.2000 |

413

| DVL3 | X3 | Y3 | Z3 |
|---|---|---|---|
| 0 | 74.0848 | 28.6050 | 393.6091 |
| 1 | 74.12 | 28.6221 | 393.5556 |
| ⋮ | ⋮ | ⋮ | ⋮ |
| ⋮ | ⋮ | ⋮ | ⋮ |
| ⋮ | ⋮ | ⋮ | ⋮ |
| ⋮ | ⋮ | ⋮ | ⋮ |
| ⋮ | ⋮ | ⋮ | ⋮ |
| 1022 | 0.1308 | 0.1299 | 0.2001 |
| 1023 | 0.1312 | 0.1313 | 0.1996 |

R4

FIG. 4

511

| DVL1 | X1 | Y1 | Z1 |
|---|---|---|---|
| 0 | 150.834 | 79.4038 | 13.3864 |
| 1 | 150.7882 | 79.3938 | 13.3748 |
| ⋮ | ⋮ | ⋮ | ⋮ |
| 209 | 140.616 | 73.65901 | 11.6434 |
| ⋮ | ⋮ | ⋮ | ⋮ |
| ⋮ | ⋮ | ⋮ | ⋮ |
| ⋮ | ⋮ | ⋮ | ⋮ |
| 1022 | 0.1308 | 0.1313 | 0.202 |
| 1023 | 0.1314 | 0.1317 | 0.2004 |

512

| DVL2 | X2 | Y2 | Z2 |
|---|---|---|---|
| 0 | 144.2945 | 292.5997 | 39.6846 |
| 1 | 144.3133 | 292.6579 | 39.6785 |
| ⋮ | ⋮ | ⋮ | ⋮ |
| ⋮ | ⋮ | ⋮ | ⋮ |
| ⋮ | ⋮ | ⋮ | ⋮ |
| 291 | 122.179 | 245.8622 | 33.03601 |
| ⋮ | ⋮ | ⋮ | ⋮ |
| 1022 | 0.1317 | 0.1321 | 0.1982 |
| 1023 | 0.1310 | 0.1312 | 0.2000 |

513

| DVL3 | X3 | Y3 | Z3 |
|---|---|---|---|
| 0 | 74.0848 | 28.6050 | 393.6091 |
| 1 | 74.12 | 28.6221 | 393.5556 |
| ⋮ | ⋮ | ⋮ | ⋮ |
| 6 | 74.12118 | 28.62028 | 393.3176 |
| ⋮ | ⋮ | ⋮ | ⋮ |
| ⋮ | ⋮ | ⋮ | ⋮ |
| ⋮ | ⋮ | ⋮ | ⋮ |
| 1022 | 0.1308 | 0.1299 | 0.2001 |
| 1023 | 0.1312 | 0.1313 | 0.1996 |

R5

FIG. 5

GAMMA CURVE AND COLOR COORDINATE ADJUSTING APPARATUS AND ADJUSTING METHOD THEREOF

BACKGROUND

Field of the Invention

The invention is directed to a gamma curve and color coordinate adjusting apparatus and method and more particularly, to the gamma curve and color coordinate adjusting method according to a color analyzing data.

Description of Related Art

With the advancement of electronic technologies, people's demands for information have been significantly increased. Accordingly, a high performance display system is necessary for an electronic apparatus.

With respect to a conventional display system, the gamma curve and optical color coordinate are always adjusted by manual. However, there are many sets of gamma registers needed to be filled up. It is a difficult job to fill up all of the gamma registers of a display system correctly. That is, it is an important course for engineers to generated information for the gamma registers efficiency and correctly.

SUMMARY

The invention provides a gamma curve and color coordinate adjusting apparatus and an adjusting method thereof for adjusting the gamma curve and the color coordinate efficiency.

The invention is directed to a gamma curve and a color coordinate adjusting method including: receiving a display image and generating a color analyzing data, wherein the color analyzing data comprises a plurality of stimulus values respectively corresponding to a plurality of driven gray levels; receiving a target color coordinate value and a target luminance value; operating a searching operation according to a setting range on the color analyzing data, calculating a simulation color coordinate value and a simulation luminance value according to the stimulus values of each of the driven voltage levels, and obtaining a plurality of adjusted node information for the gamma curve and the color coordinate according to a difference between the target color coordinate value and the simulation color coordinate value and a difference between the target luminance value and the simulation luminance value corresponding to each of the driven voltage levels.

The invention is directed to a gamma curve and color coordinate adjusting apparatus. The gamma curve and color coordinate adjusting apparatus includes a display color analyzer, and a controller. The display color analyzer receives a display image and generates a color analyzing data, wherein the color analyzing data comprises a plurality of stimulus values respectively corresponding to a plurality of driven gray levels. The controllers is coupled to the display color analyzer. The controller receives a target color coordinate value and a target luminance value, operates a searching operation according to a setting range on the color analyzing data, calculates a simulation color coordinate value and a simulation luminance value according to the stimulus values of each of the driven voltage levels, and obtains a plurality of adjusted node information for the gamma curve and the color coordinate according to a difference between the target color coordinate value and the simulation color coordinate value and a difference between the target luminance value and the simulation luminance value corresponding to each of the driven voltage levels.

To sum up, the present disclosure provides a gamma curve and color coordinate adjusting apparatus for adjusting a gamma curve and a color coordinate of a display system according to color analyzing data and a target color coordinate value and a target luminance value. That is, a necessary gamma curve and color coordinate can be obtain automatically by the gamma curve and color coordinate adjusting apparatus when the color analyzing data is obtained. Also, an engineer for the display system can adjust the gamma curve and color coordinate easily by adjust the target color coordinate value and the target luminance value. The efficiency of the display system is improved.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 3A and FIG. 3B are schematic plots for obtaining adjusted node information for the gamma curve and the color coordinate according to an embodiment of present disclosure.

FIG. 4 is schematic plot for obtaining adjusted node information for the gamma curve and the color coordinate according to the other embodiment of present disclosure.

FIG. 5 is schematic plot for obtaining adjusted node information for the gamma curve and the color coordinate according to another embodiment of present disclosure.

DESCRIPTION OF EMBODIMENTS

Figure 1:
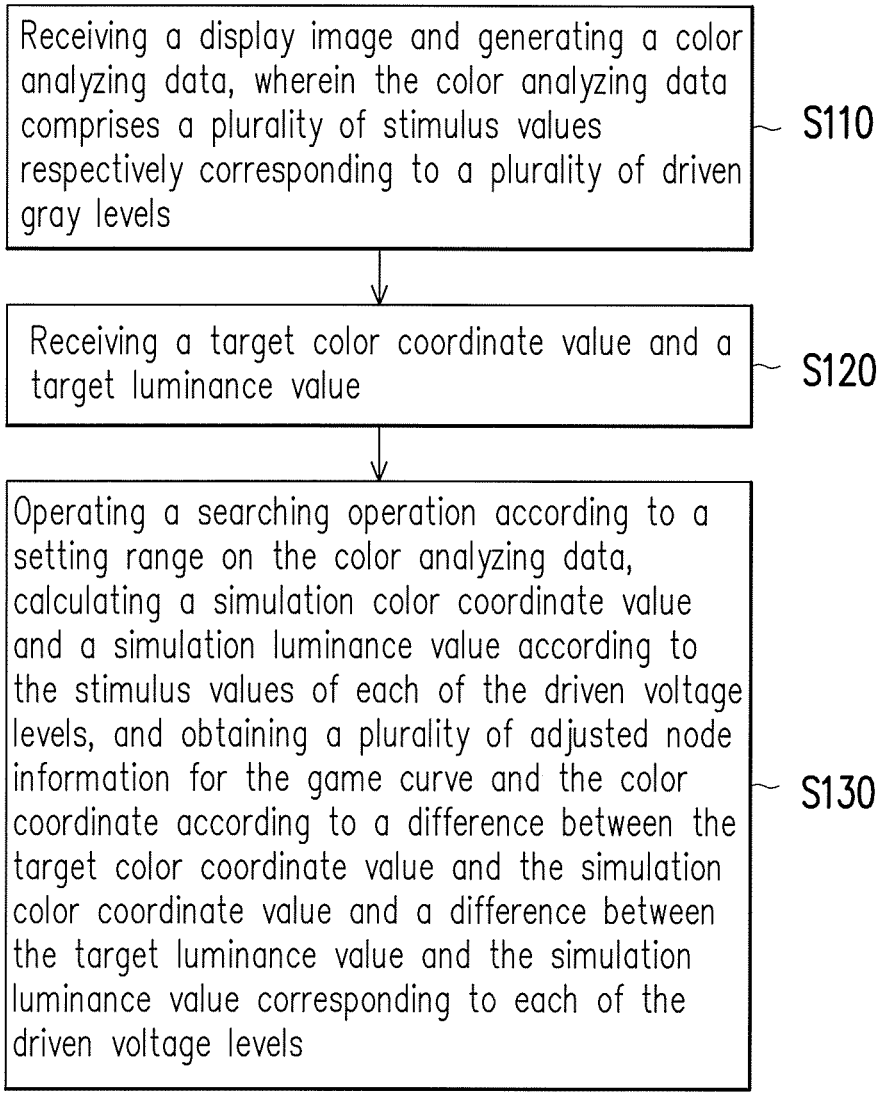
FIG. 1 is a flow chart for gamma curve and color coordinate adjusting method according to an embodiment of the present disclosure.

Referring to FIG. 1, FIG. 1 is a flow chart for gamma curve and color coordinate adjusting method according to an embodiment of the present disclosure. In FIG. 1, the step S110 is executed for receiving a display image and generating a color analyzing data. Wherein, the display image can be received by a display color analyzer. The display color analyzer may be used to receive the display image from a display panel, and generate the color analyzing data according to the display image. In here, the color analyzing data includes a plurality of stimulus values respectively corresponding to a plurality of driven gray levels. In detail, please referring to table I shown as below:

TABLE I

| Driven voltage level | X stimulus value | Y stimulus value | Z stimulus value |
|---|---|---|---|
| First color analyzing data: | | | |
| 0 | X1[0] | Y1[0] | Z1[0] |
| 1 | X1[1] | Y1[1] | Z1[1] |
| 2 | X1[2] | Y1[2] | Z1[2] |
| | | . . . | |
| 1023 | X1[1023] | Y1[1023] | Z1[1023] |
| Second color analyzing data: | | | |
| 0 | X2[0] | Y2[0] | Z2[0] |
| 1 | X2[1] | Y2[1] | Z2[1] |
| 2 | X2[2] | Y2[2] | Z2[2] |
| | | . . . | |
| 1023 | X2[1023] | Y2[1023] | Z2[1023] |
| Third color analyzing data: | | | |
| 0 | X3[0] | Y3[0] | Z3[0] |
| 1 | X3[1] | Y3[1] | Z3[1] |
| 2 | X3[2] | Y3[2] | Z3[2] |
| | | . . . | |
| 1023 | X3[1023] | Y3[1023] | Z3[1023] |

The color analyzing data may include a first primary color analyzing data, a second primary color analyzing data, and a third primary color analyzing data. The first, second and third primary color analyzing data may respectively are red, green and blue analyzing data. Each of the primary color analyzing data can be indexed by a plurality of driven voltage levels, and three (X, Y and Z) stimulus values are corresponding to one of the driven voltage level. In here, the driven voltage level A means a driving voltage value fed to the display panel for displaying an image with gray level A.

In the step S120, a target color coordinate value and a target luminance value are received, wherein a x target color coordinate value and a y target color coordinate value are received. Then, in the step S130, a searching operation is operated according to a setting range on the color analyzing data, a simulation color coordinate value and a simulation luminance value according to the stimulus values of each of the driven voltage levels is calculated, and a plurality of adjusted node information for the gamma curve and the color coordinate are obtained according to a difference between the target color coordinate value and the simulation color coordinate value and a difference between the target luminance value and the simulation luminance value corresponding to each of the driven voltage levels.

Figure 2A:
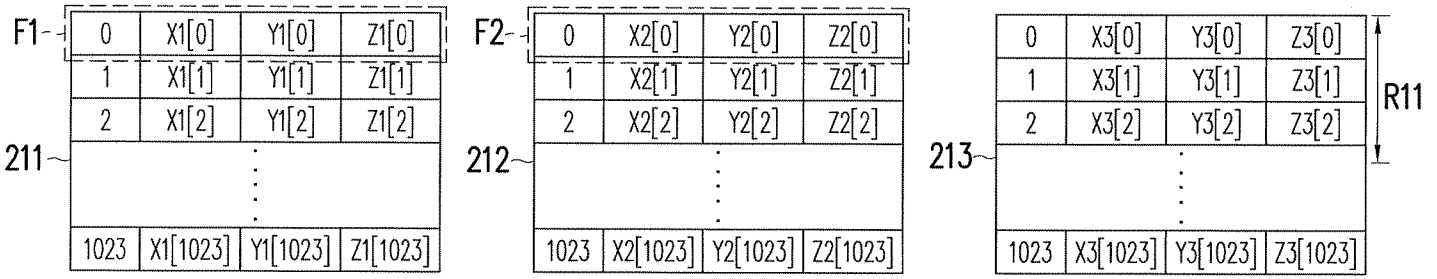
FIG. 2A to FIG. 2C are schematic plots of the searching operation according to an embodiment of present disclosure.
Figure 2B:
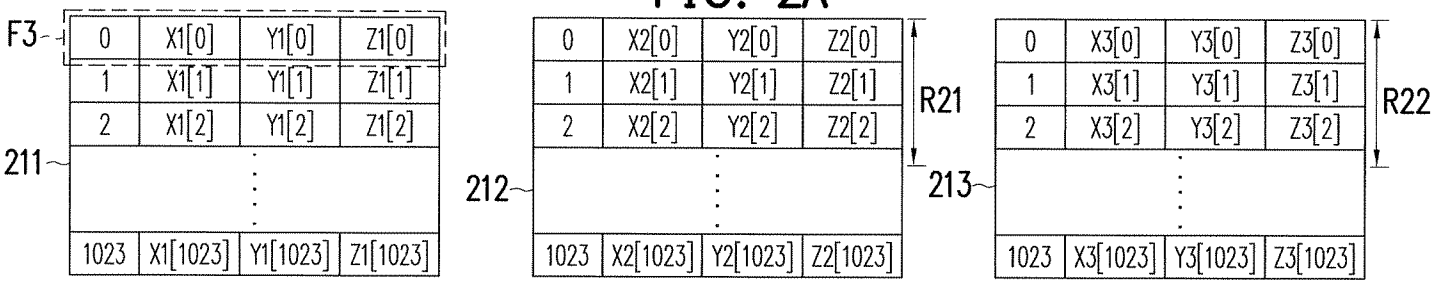
Figure 2C:
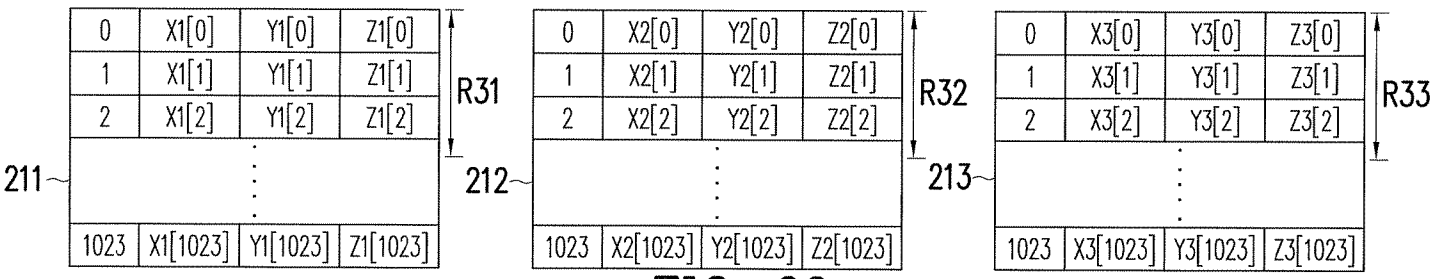

In this embodiment, the searching operation may be performed on the color analyzing data by different levels. Referring to FIG. 2A to FIG. 2C, FIG. 2A to FIG. 2C are schematic plots of the searching operation according to an embodiment of present disclosure. In FIG. 2A, during the searching operation with single level, indexes on the first and second primary color analyzing data 211 and 212 are fixed at the driven voltage level 0 (such as the fields F1 and F2), and an index on the third primary color analyzing data 213 is scanned from the driven voltage level 0 within the setting range R11. For example, if the setting range R11 is 350, the search range of the searching operation with single level is among the driven voltage levels 0 for the first and second primary color analyzing data 211 and 212, the driven voltage levels 0-350 for the third primary color analyzing data 213.

In FIG. 2B, a searching operation with dual levels is illustrated. During the searching operation with dual levels, an index on the first primary color analyzing data 211 is fixed at the driven voltage level 0 (such as the field F3), and indexes on the second and third primary color analyzing data 212 and 213 are respectively scanned from the driven voltage level 0 within the setting ranges R21 and R22, wherein the setting ranges R21 and R22 are the same. Additionally, the searching operation with dual levels includes the searching operation with single level, and there are 350×350 driven voltage levels are searched in the searching operation with dual levels if both of the setting levels R21 and R22 are 350.

In FIG. 2C, a searching operation with triple levels is illustrated. During the searching operation with triple levels, and an indexes on the first, second and third primary color analyzing data 211, 212 and 213 are respectively scanned from the driven voltage level 0 within the setting ranges R31, R32 and R33, wherein the setting ranges R31, R32 and R33 are the same. Additionally, the searching operation with triple levels includes the searching operations with dual levels and single level, and there are 350×350×350 driven voltage levels are searched in the searching operation with dual levels if both of the setting levels R31, R32 and R33 are 350.

The detail operation of the step S130 can be referred to FIG. 3A and FIG. 3B, wherein FIG. 3A and FIG. 3B are schematic plots for obtaining adjusted node information for the gamma curve and the color coordinate according to an embodiment of present disclosure. In FIG. 3A, a search operation on the first primary color analyzing data, second primary color analyzing data and third primary color analyzing data 311, 312 and 313 with triple levels is operated. During the search operation, a x simulation color coordinate value and a y simulation color coordinate value are calculated for each step of the search operation. The x simulation color coordinate value and a y simulation color coordinate value can be calculated by following formula (1) and (2):

$$\text{the } x \text{ simulation color coordinate value (sim_x)} = \frac{X1[i] + X2[j] + X3[k]}{(X1[i] + X2[j] + X3[k]) + (Y1[i] + Y2[j] + Y3[k]) + (Z1[i] + Z2[j] + Z3[k])} \quad (1)$$

$$\text{the } y \text{ simulation color coordinate value (sim_y)} = \frac{Y1[i] + Y2[j] + Y3[k]}{(X1[i] + X2[j] + X3[k]) + (Y1[i] + Y2[j] + Y3[k]) + (Z1[i] + Z2[j] + Z3[k])} \quad (2)$$

Wherein, the X1[i] is the X stimulus value corresponding to the $i^{th}$ driven gay level in the first primary color analyzing data 311, the X2[j] is the X stimulus value corresponding to the $j^{th}$ driven gray level in the second primary color analyzing data 312, the X3[k] is the X stimulus value corresponding to the $k^{th}$ driven gray level in the third primary color analyzing data 313, the Y1[i] is the Y stimulus value corresponding to the $i^{th}$ driven gray level in the first primary color analyzing data 311, the Y2[j] is the Y stimulus value corresponding to the $i^{th}$ driven gray level in the second primary color analyzing data 312, the Y3[k] is the Y stimulus value corresponding to the $k^{th}$ driven gray level in the third primary color analyzing data 313, the Z1[i] is a Z stimulus value corresponding to the $i^{th}$ driven gray level in the first primary color analyzing data 311, the Z2[j] is the Z stimulus value corresponding to the $j^{th}$ driven gray level in the second primary color analyzing data 312, the Z3[k] is the Z stimulus value corresponding to the $k^{th}$ driven gray level in the third primary color analyzing data 313.

On the other hand, difference values between the target color coordinate value and the simulation color coordinate value are calculated. An absolute value of difference between the x simulation color coordinate value and the x target color coordinate value is calculated to obtain a first difference value, and an absolute value of difference between the y simulation color coordinate value and the y target color coordinate value is calculated to obtain a second difference. The first and second difference values are respectively compared by a x difference limit and a y difference limit. If both of the first and second difference values are respectively smaller than the x difference limit and the y difference limit, the corresponding driven voltage levels of the first, second and third primary color analyzing data are recorded to be a first adjusted node information.

For example, in FIG. 3A, when the driven voltage level 155 of the first primary color analyzing data 311, the driven voltage level 281 of the second primary color analyzing data 312, and the driven voltage level 62 of the third primary color analyzing data 313 are searched during the search operation, the x simulation color coordinate value and the y simulation color coordinate value are respectively calculated according to the formulas (1) and (2), and the x simulation color coordinate value is 0.302967, and the y simulation color coordinate value is 0.312887. In this embodiment, the x and y target color coordinate values are respectively set to 0.30 and 0.31, and the x difference limit and y difference limit are respectively set to 0.003 and 0.003. The first difference value=0.302967−0.30=0.002967, and the second difference value=0.312887−0.31=0.002887. Accordingly, both of the first and second difference values are respectively smaller than the x difference limit and y difference limit, the driven voltage levels 155, 281, 62 and the stimulus values correspondingly are recorded to be the first adjusting node information.

It should be noted here, if the first adjusted node information is determined, the search operation may be stopped. On the contrary, if not both of the first and second difference values are respectively smaller than the x difference limit and the y difference limit, the search operation may keep on executing till the first adjusted node information can be determined.

Moreover, a maximum luminance value of the gamma curve can be obtained by adding all of the Y stimulus values corresponding to the first adjusted node information. In the embodiment of FIG. 3A, the maximum luminance value can be obtained according to the Y stimulus values in the driven voltage levels 155, 281, 62 of first, second and third primary color analyzing data 311, 312 and 313, respectively. That is, the maximum luminance value=76.57605+249.5927+28.26703=354.4358. On the other hand, a minimum luminance value may be obtained by adding minimum luminance values of the first, second and third primary color analyzing data 311, 312 and 313. The minimum luminance values of the first, second and third primary color analyzing data 311, 312 and 313 can be found on the Y stimulus values of driven voltage level 1023 of the first, second and third primary color analyzing data 311, 312 and 313. That is, in the example of FIG. 3A, the minimum luminance value=0.1317+0.1312+0.1313=0.394303.

The maximum and minimum luminance values can respectively be maximum and minimum luminance values of the adjusted gamma curve. That is, a relationship between luminance and gray levels can be obtained by follow formula (3): Luminance=(maximum luminance value−minimum luminance value)*$(255-i)^{2.2}$/255+minimum luminance value (3), wherein i is the gray level and between 0-255.

Furthermore, after the first adjusting node information is determined, a plurality of second adjusting node information need to be determined, too. In the example in FIG. 3B, the search operation is executed continually. The x and y simulation color coordinate values and a simulation luminance value sim_Y are calculated for each step of the search operation. Wherein, the simulation luminance value sim_Y can be calculated by formula (4) which is shown as below:

$$\text{sim_}Y=Y1[i]+Y2[j]+Y3[k] \quad (4)$$

Furthermore, a difference luminance ratio according to the simulation luminance value and the target luminance value corresponding to one of the driven voltage levels is calculated, wherein the difference luminance ratio=(SimY−TarY)/TarY, wherein the SimY is the simulation luminance values corresponding to one of the driven voltage levels, and the TarY is the target luminance value. In the example of FIG. 3B, supposed TarY=351.3895, when the driven voltage levels 169, 287 and 86 of the first, second and third primary color analyzing data 311, 312 and 323 are searched by the search operation, the difference luminance ratio=351.3895−351.389469)/351.3895=0.0000000822. Please noted here, the target luminance value can be obtained by the formula (3) by setting i=1.

Furthermore, the first difference value and second difference value can be also obtained at the same time, and in the example of FIG. 3B, the first and second difference values are 0.002913 and 0.002747, respectively. Therefore, a difference summation can be calculated by adding the difference luminance ratio, the first difference value and the second difference value, and the difference summation=0.005662.

It can be easily known, during the search operation within the setting range, a plurality of difference summations can be obtained. A minimum value of the difference summations is selected to obtain a selected difference summation, wherein first and second difference values corresponding to the selected difference summation are respectively smaller than the x difference limit and y difference limit. That is, in the example of FIG. 3B, the driven voltage levels 169, 287 and 86 of the first, second and third primary color analyzing data 311, 312 and 323 can be selected to be the second adjusted node information.

Furthermore, by adjusting the number of i, the target luminance value can be adjusted according to the formula (3), and another second adjusted node information can be obtained by repeat the search operation in the example of FIG. 3B. That is, more second adjusted node information can be obtained, and the gamma curve and the color coordinate can be adjusted automatically.

Referring to FIG. 4, wherein FIG. 4 is schematic plot for obtaining adjusted node information for the gamma curve and the color coordinate according to the other embodiment of present disclosure. In FIG. 4, an search operation is executed on the first, second and third primary color analyzing data 411, 412 and 413 according to a setting range R4. A x simulation color coordinate value and a y simulation color coordinate value are calculated according to formula (2) and (3) for each step of the search operation. Also, a first difference value and second difference value are calculated correspondingly. Further, whether both of the first and second difference values are respectively smaller than a x difference limit and a y difference limit or not is determined, and if both of the first and second difference values are respectively smaller than the x difference limit and the y difference limit, the corresponding driven voltage level is recorded to be a first adjusted node information, In FIG. 4, when the driven voltage level 131 of the first primary color analyzing data 411, the driven voltage level 272 of the second primary color analyzing data 412, and the driven voltage level 1 of the third primary color analyzing data 413 are searched during the search operation, the x simulation color coordinate value and the y simulation color coordinate value are respectively calculated according to the formulas (1) and (2), and the x simulation color coordinate value is 0.302996, and the y simulation color coordinate value is 0.312994. In this embodiment, the x and y target color coordinate values are respectively set to 0.30 and 0.31, and the x difference limit and y difference limit are respectively set to 0.003 and 0.003. The first difference value=0.302996−0.30=0.002996, and the second difference value=0.312994−0.31=0.002994. Accordingly, both of the first and second difference values are respectively smaller than the x difference limit and y difference limit, the driven voltage levels 131, 272, 1 and the stimulus values correspondingly are recorded to be the first adjusting node information.

That is, a maximum luminance value and a minimum luminance value of the adjusted gamma curve can be obtained, and luminance of each node of the adjusted gamma curve can be obtained according to the formula (3).

After the first adjusting node information is obtained, the search operation can be executed continually, and a plurality of second adjusting node information can be obtained. In this embodiment, a distance between the target color coordinate value and the simulation color coordinate value is calculated, and whether the distance between the target color coordinate value and the simulation color coordinate value corresponding to each of the driven voltage levels is smaller than a limit distance or not is determined.

In detail, a x difference between the x target color coordinate value and the x simulation color coordinate value, and a y difference between the y target color coordinate value and the y simulation color coordinate value are calculated. Then, square of the x difference and square of the y difference are summed, and a square root of the summation is calculated to obtain the distance between the target color coordinate value and the simulation color coordinate value is calculated. Further, a square root of a summation of square of the x difference limit and square of the y difference limit is calculated to obtain the limit distance. By comparing the limit distance and the distance between the target color coordinate value and the simulation color coordinate value, whether the distance between the target color coordinate value and the simulation color coordinate value corresponding to each of the driven voltage levels is smaller than a limit distance or not can be determined.

If the distance between the target color coordinate value and the simulation color coordinate value corresponding to each of the driven voltage levels is determined to be smaller than the limit distance, and further if the x and y simulation color coordinate values are respectively smaller than the x difference limit and y difference limit, the corresponding driven voltage level may be recorded in a data base. Then, when the search operation is completed, luminance differences of all of the driven voltage levels recorded in the data base are calculated, and one of the driven voltage levels in the storage bank is selected to be a second adjusted node information. Wherein, the luminance difference is absolute value of difference between the simulation luminance and the target luminance, and the selected driven voltage level has a minimum luminance difference.

Referring to FIG. 5, wherein FIG. 5 is schematic plot for obtaining adjusted node information for the gamma curve and the color coordinate according to another embodiment of present disclosure. In FIG. 5, a search operation is executed on the first, second and third primary color analyzing data 511, 512 and 513 according to a setting range R5. A x simulation color coordinate value and a y simulation color coordinate value are calculated according to formula (2) and (3) for each step of the search operation. Also, a first difference value and second difference value are calculated correspondingly. Further, a distance between the simulation coordinate value and the target coordinate value is calculated. In detail, square of the first difference value and square of the second difference value are summed to obtain a summation, and a square root and the summation is calculated to obtain the distance between the simulation coordinate value and the target coordinate value. Besides, a distance limit is obtained by calculating a square root of a summation of square of the x difference limit and square of the y difference limit. Then, by selecting a minimum value of the distances which is smaller than a distance limit to obtain a selected distance, and the driven voltage level corresponding to the selected distance can be recorded to be a first adjusted node information.

For the example in FIG. 5, the driven voltage levels 209, 291, and 6 of the first, second, and third primary color analyzing data 511, 512 and 513 are searched. The x simulation color coordinate value and the y simulation color coordinate value are respectively 0.3 and 0.309995. Moreover, if the x target color coordinate value is 0.3, the y target color coordinate value is 0.31, the x difference limit is 0.003 and the y difference limit is 0.003, the first difference value and the second difference value are respectively 0.0 and 0.000005. Furthermore; the distance between the simulation coordinate value and the target coordinate value is calculated to be 0.00000486, and the distance limit is calculated to be 0.004243. In this embodiment, the distance between the simulation coordinate value and the target coordinate value is much smaller than the distance limit, and if the distance corresponding to the voltage driven levels 209, 291 and 6 is minimum during the search operation, the voltage driven levels 209, 291 and 6 is recoded to be a first adjusted node information.

That is, a maximum luminance value and a minimum luminance value of the adjusted gamma curve can be obtained, and luminance of each node of the adjusted gamma curve can be obtained according to the formula (3).

After the first adjusting node information is obtained, the search operation can be executed continually, and a plurality of second adjusting node information can be obtained. In this embodiment, if the distance between the target color coordinate value and the simulation color coordinate value corresponding one of the driven voltage levels is smaller than the distance limit, and the x and y simulation color coordinate values are respectively smaller than the x difference limit and y difference limit, the corresponding driven voltage level is recorded to be a second adjusted node information.

Figure 6:
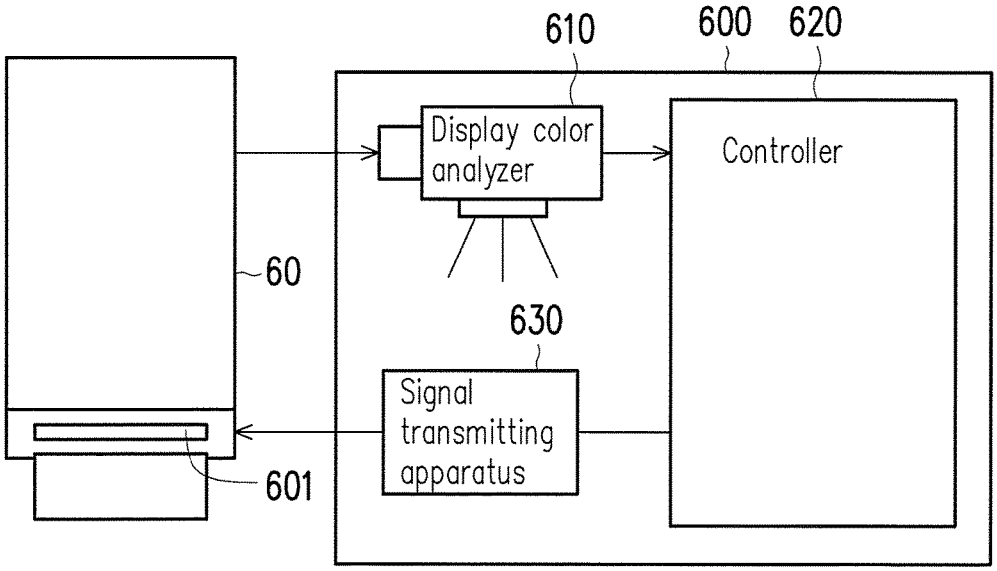
FIG. 6 is a block diagram of a color coordinate and gamma curve adjusting apparatus of an embodiment according to present disclosure.

Referring to FIG. 6, FIG. 6 is a block diagram of a color coordinate and gamma curve adjusting apparatus of an embodiment according to present disclosure. The color coordinate and gamma curve adjusting apparatus 600 includes a display analyzer 610, a controller 620, and a signal transmitting apparatus 630. The display color analyzer 610 coupled to a display panel 60, receives a display image from the display panel 60 and generates a color analyzing data, wherein the color analyzing data comprises a plurality of stimulus values respectively corresponding to a plurality of driven gray levels. The controller 620 is coupled to the display color analyzer 610, receives the color analyzing data and executes the step S130 in FIG. 1. The signal transmitting apparatus 630 is coupled to the controller 620, and transmits all of the adjusting node information to a display driver 601. The display driver 601 is used to drive the display panel 60, and one or more gamma value register in the display driver 601 are used to record the adjusting node information.

In some embodiment, the controller 620 may be a processor (such as CPU or DSP) for executing program to process step S130. The detail operations of the step S130 have been described detail in above embodiments.

To conclude, the color coordinate and gamma curve adjusting information by the color coordinate and gamma curve adjusting apparatus automatically. A plurality of values of gamma registers can be filled up without manual operation. The performance of a display system can be improved efficiency.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A color coordinate and gamma curve adjusting method, comprising:

receiving, by a display color analyzer, a display image and generating a color analyzing data, wherein the color analyzing data comprises a plurality of stimulus values respectively corresponding to a plurality of driven gray levels;

receiving, by a controller, a target color coordinate value and a target luminance value;

operating, by the controller, a searching operation according to within a setting range on the color analyzing data via the display color analyzer, calculating, by the controller, a simulation color coordinate value and a simulation luminance value according to the stimulus values of each of the driven voltage levels, and obtaining, by the controller, a plurality of adjusted node information for the gamma curve and the color coordinate according to a difference between the target color coordinate value and the simulation color coordinate value and a difference between the target luminance value and the simulation luminance value corresponding to each of the driven voltage levels within the setting range; and transmitting, by the controller, all of the adjusted node information to a display driver to update content of at least one gamma value register of the display driver, wherein the color analyzing data comprises a first primary color analyzing data, a second primary color analyzing data and a third primary color analyzing data, the target color coordinate value comprises a x target color coordinate value and a y target color coordinate value, and the stimulus values comprises a X stimulus value, a Y stimulus value and a Z stimulus value, wherein the simulation color coordinate value comprises a x simulation color coordinate value and a y simulation color coordinate value, and the x simulation color coordinate value=

$$\frac{X1[i]+X2[j]+X3[k]}{(X1[i]+X2[j]+X3[k])+(Y1[i]+Y2[j]+Y3[k])+(Z1[i]+Z2[j]+Z3[k])},$$

the $y$ simulation color coordinate value =

$$\frac{Y1[i]+Y2[j]+Y3[k]}{(X1[i]+X2[j]+X3[k])+(Y1[i]+Y2[j]+Y3[k])+(Z1[i]+Z2[j]+Z3[k])},$$

wherein, the X1[i] is the X stimulus value corresponding to the ith driven gray level in the first primary color analyzing data, the X2[j] is the X stimulus value corresponding to the jth driven gray level in the second primary color analyzing data, the X3[k] is the X stimulus value corresponding to the kth driven gray level in the third primary color analyzing data, the Y1[i] is the Y stimulus value corresponding to the ith driven gray level in the first primary color analyzing data, the Y2[j] is the Y stimulus value corresponding to the jth driven gray level in the second primary color analyzing data, the Y3[k] is the Y stimulus value corresponding to the kth driven gray level in the third primary color analyzing data, the Z1[i] is a Z stimulus value corresponding to the ith driven gray level in the first primary color analyzing data, the Z2[j] is the Z stimulus value corresponding to the jth driven gray level in the second primary color analyzing data, the Z3[k] is the Z stimulus value corresponding to the kth driven gray level in the third primary color analyzing data.

2. The color coordinate and gamma curve adjusting method according to claim 1, wherein the simulation luminance value=Y1[i]+Y2[j]+Y3[k].

3. The color coordinate and gamma curve adjusting method according to claim 1, wherein the step of obtaining the adjusted node information for the gamma curve and the color coordinate according to the difference between the target color coordinate value and the simulation color coordinate value and the difference between the target luminance value and the simulation luminance value comprises:

calculating absolute value of difference between the x simulation color coordinate value and the x target color coordinate value to obtain a first difference value, and calculating absolute value of difference between the y simulation color coordinate value and the y target color coordinate value to obtain a second difference value; and determining whether both of the first and second difference values are respectively smaller than a x difference limit and a y difference limit or not, wherein, if both of the first and second difference values are respectively smaller than the x difference limit and the y difference limit, the corresponding driven voltage level is recorded to be a first adjusted node information.

4. The color coordinate and gamma curve adjusting method according to claim 3, wherein the step of obtaining the adjusted node information for the gamma curve and the color coordinate according to the difference between the target color coordinate value and the simulation color coordinate value and the difference between the target luminance value and the simulation luminance value further comprises:

obtaining a maximum luminance value by adding the Y stimulus values corresponding to the first adjusted node information; and obtaining a minimum luminance value by adding minimum luminance values of the first primary color analyzing data, the second primary color analyzing data and the third primary color analyzing data.

5. The color coordinate and gamma curve adjusting method according to claim 4, further comprising:

obtaining an adjusted gamma curve according to the maximum luminance value and the minimum luminance value.

6. The color coordinate and gamma curve adjusting method according to claim 3, wherein the step of obtaining the adjusted node information for the gamma curve and the color coordinate according to the difference between the target color coordinate value and the simulation color coordinate value and the difference between the target luminance value and the simulation luminance value further comprises:

continually executing the searching operation after a previously adjusted node information being obtained;

calculating a difference luminance ratio according to the simulation luminance value and the target luminance value corresponding to one of the driven voltage levels, wherein the difference luminance ratio=(SimY−TarY)/TarY, wherein the SimY is the simulation luminance values corresponding to one of the driven voltage levels, and the TarY is the target luminance value;

obtaining a plurality of difference summations by adding the difference luminance ratio and the first and second difference values corresponding to each of the driven voltage levels; and selecting a minimum value of the difference summations to obtain a selected difference summation, and the first and second difference values corresponding to the selected difference summation are respectively smaller than the x difference limit and y difference limit, wherein, the driven voltage level corresponding to the selected difference summation are recorded to be a second adjusted node information.

7. The color coordinate and gamma curve adjusting method according to claim 3, wherein the step of obtaining the adjusted node information for the gamma curve and the color coordinate according to the difference between the target color coordinate value and the simulation color coordinate value and the difference between the target luminance value and the simulation luminance value further comprises:

continually executing the searching operation after a previously adjusted node information being obtained;

determining whether a distance between the target color coordinate value and the simulation color coordinate value corresponding to each of the driven voltage levels being smaller than a limit distance, wherein, if the distance between the target color coordinate value and the simulation color coordinate value corresponding to each of the driven voltage levels being smaller than the limit distance, and if the x and y simulation color coordinate values are respectively smaller than the x difference limit and y difference limit, the corresponding driven voltage level is recorded in a storage base; and selecting one of the driven voltage levels in the storage bank to be a second adjusted node information which the selected driven voltage level has a minimum luminance difference between the simulation luminance and the target luminance.

8. The color coordinate and gamma curve adjusting method according to claim 1, wherein the step of obtaining the adjusted node information for the gamma curve and the color coordinate according to the difference between the target color coordinate value and the simulation color coordinate value and the difference between the target luminance value and the simulation luminance value comprises: obtaining a plurality of distances between the target color coordinate value and the simulation color coordinate values respectively corresponding to each of the driven voltage levels; selecting a minimum value of the distances which is smaller than a distance limit to obtain a selected distance; and recording the driven voltage level corresponding to the selected distance to be a first adjusted node information.

9. The color coordinate and gamma curve adjusting method according to claim 8, wherein the step of obtaining the adjusted node information for the gamma curve and the color coordinate according to the difference between the target color coordinate value and the simulation color coordinate value and the difference between the target luminance value and the simulation luminance value further comprises:

continually executing the searching operation after a previously adjusted node information being obtained;

recording the corresponding driven voltage level to be a second adjusted node information if the distance between the target color coordinate value and the simulation color coordinate value corresponding one of the driven voltage levels is smaller than the distance limit, and the x and y simulation color coordinate values are respectively smaller than the x difference limit and y difference limit.

10. A color coordinate and gamma curve adjusting apparatus, comprising:

a display color analyzer, receiving a display image and generating a color analyzing data, wherein the color analyzing data comprises a plurality of stimulus values respectively corresponding to a plurality of driven gray levels;

a controller, coupled to the display color analyzer, receiving a target color coordinate value and a target luminance value, operating a searching operation according to within a setting range on the color analyzing data, calculating a simulation color coordinate value and a simulation luminance value according to the stimulus values of each of the driven voltage levels, and obtaining a plurality of adjusted node information for the gamma curve and the color coordinate according to a difference between the target color coordinate value and the simulation color coordinate value and a difference between the target luminance value and the simulation luminance value corresponding to each of the driven voltage levels within the setting range, and transmitting all of the adjusted node information to a display driver to update content of at least one gamma value register of the display driver, wherein the color analyzing data comprises a first primary color analyzing data, a second primary color analyzing data and a third primary color analyzing data, the target color coordinate value comprises a x target color coordinate value and a y target color coordinate value, and the stimulus values comprises a X stimulus value, a Y stimulus value and a Z stimulus value, wherein the simulation color coordinate value comprises a x simulation color coordinate value and a y simulation color coordinate value, and the x simulation color coordinate value=

$$\frac{X1[i]+X2[j]+X3[k]}{(X1[i]+X2[j]+X3[k])+(Y1[i]+Y2[j]+Y3[k])+(Z1[i]+Z2[j]+Z3[k])},$$

-continued the $y$ simulation color coordinate value =

$$\frac{Y1[i]+Y2[j]+Y3[k]}{(X1[i]+X2[j]+X3[k])+(Y1[i]+Y2[j]+Y3[k])+(Z1[i]+Z2[j]+Z3[k])},$$

wherein, the X1[i] is the X stimulus value corresponding to the ith driven gray level in the first primary color analyzing data, the X2[j] is the X stimulus value corresponding to the jth driven gray level in the second primary color analyzing data, the X3[k] is the X stimulus value corresponding to the kth driven gray level in the third primary color analyzing data, the Y1[i] is the Y stimulus value corresponding to the ith driven gray level in the first primary color analyzing data, the Y2[j] is the Y stimulus value corresponding to the jth driven gray level in the second primary color analyzing data, the Y3[k] is the Y stimulus value corresponding to the kth driven gray level in the third primary color analyzing data, the Z1[i] is a Z stimulus value corresponding to the ith driven gray level in the first primary color analyzing data, the Z2[j] is the Z stimulus value corresponding to the jth driven gray level in the second primary color analyzing data, the Z3[k] is the Z stimulus value corresponding to the kth driven gray level in the third primary color analyzing data.

11. The color coordinate and gamma curve adjusting apparatus according to claim 10, wherein the simulation luminance value=Y1[i]+Y2[j]+Y3[k].

12. The color coordinate and gamma curve adjusting apparatus according to claim 10, wherein the controller calculates absolute value of difference between the x simulation color coordinate value and the x target color coordinate value to obtain a first difference value, and calculating absolute value of difference between the y simulation color coordinate value and the y target color coordinate value to obtain a second difference value, determines whether both of the first and second difference values are respectively smaller than a x difference limit and a y difference limit or not, and if both of the x simulation color coordinate value and the y simulation color coordinate value are respectively smaller than the x difference limit and the y difference limit, the corresponding driven voltage level is recorded to be a first adjusted node information.

13. The color coordinate and gamma curve adjusting apparatus according to claim 12, wherein the controller further obtains a maximum luminance value by adding the Y stimulus values corresponding to the first adjusted node information, and obtains a minimum luminance value by adding minimum luminance values of the first primary color analyzing data, the second primary color analyzing data and the third primary color analyzing data.

14. The color coordinate and gamma curve adjusting apparatus according to claim 13, wherein the controller further obtains an adjusted gamma curve according to the maximum luminance value and the minimum luminance value.

15. The color coordinate and gamma curve adjusting apparatus according to claim 12, wherein the controller further continually executes the searching operation after a previously adjusted node information is obtained, calculates a difference luminance ratio according to the simulation luminance value and the target luminance value corresponding to one of the driven voltage levels, wherein the difference luminance ratio=(SimY−TarY)/TarY, wherein the SimY is the simulation luminance values corresponding to one of the driven voltage levels, and the TarY is the target luminance value, obtains a plurality of difference summations by adding the difference luminance ratio, the x simulation color coordinate value, and the y simulation color coordinate value corresponding to each of the driven voltage levels, and selects a minimum value of the difference summations to obtain a selected difference summation, and the x and y simulation color coordinate values corresponding to the selected difference summation are respectively smaller than the x difference limit and y difference limit, wherein, the driven voltage level corresponding to the selected difference summation are recorded to be a second adjusted node information.

16. The color coordinate and gamma curve adjusting apparatus according to claim 13, wherein the controller continually executes the searching operation after a previously adjusted node information being obtained, determines whether a distance between the target color coordinate value and the simulation color coordinate value corresponding to each of the driven voltage levels being smaller than a limit distance, wherein, if the distance between the target color coordinate value and the simulation color coordinate value corresponding to each of the driven voltage levels being smaller than the limit distance, and if the x and y simulation color coordinate values are respectively smaller than the x difference limit and y difference limit, the corresponding driven voltage level is recorded in a storage base, then the controller further selects one of the driven voltage levels in the storage bank to be a second adjusted node information which the selected driven voltage level has a minimum luminance difference between the simulation luminance and the target luminance.

* * * * *